US006768881B2

(12) United States Patent
Hatori

(10) Patent No.: US 6,768,881 B2
(45) Date of Patent: Jul. 27, 2004

(54) DEVELOPING DEVICE AND IMAGE FORMING APPARATUS USING THE SAME

(75) Inventor: Satoshi Hatori, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/115,976

(22) Filed: Apr. 5, 2002

(65) Prior Publication Data

US 2002/0159781 A1 Oct. 31, 2002

(30) Foreign Application Priority Data

Apr. 9, 2001 (JP) ..... 2001-109692

(51) Int. Cl.[7] ..... G03G 15/10; G03G 15/08
(52) U.S. Cl. ..... 399/63; 399/30; 399/62
(58) Field of Search ..... 399/27, 30, 58, 399/61, 62, 63, 256

(56) References Cited

U.S. PATENT DOCUMENTS 4,901,115 A * 2/1990 Nakamura et al. ..... 399/63
4,956,669 A * 9/1990 Nakamura ..... 399/62 X
4,963,929 A * 10/1990 Ueda et al. ..... 399/62
5,111,247 A * 5/1992 Nichols ..... 399/63
5,189,475 A * 2/1993 Fournia et al. ..... 399/63
5,465,140 A * 11/1995 Nakamura et al. ..... 399/62
5,508,793 A * 4/1996 Kimura et al. ..... 399/63
5,722,002 A * 2/1998 Kikuta et al. ..... 399/30
5,784,669 A 7/1998 Miura et al.
5,915,155 A 6/1999 Shoji et al.
6,122,469 A 9/2000 Miura et al.
6,125,243 A 9/2000 Shoji et al.
6,438,330 B1 * 8/2002 Itoh ..... 399/27

FOREIGN PATENT DOCUMENTS

JP 06-019315 1/1994
JP 2000-056555 2/2000

* cited by examiner

*Primary Examiner*—Sandra L. Brase
(74) *Attorney, Agent, or Firm*—Oblon, Spivak, McClelland, Maier & Neustadtm, P.C,

(57) ABSTRACT

A developing device of the present invention includes a conveying member for conveying a developer that is a toner and carrier mixture. A sensor senses the toner content of the developer in terms of the permeability of the developer. A preventing member prevents the bulk density of the developer from varying when fresh toner is not replenished. The developing device obviates erroneous toner content sensing when fresh toner is not replenished. An image forming apparatus including the developing device is also disclosed.

11 Claims, 6 Drawing Sheets

DEVELOPING DEVICE AND IMAGE FORMING APPARATUS USING THE SAME

BACKGROUND OF THE INVENTION

1. Field of the Invention

The present invention relates to a copier, facsimile apparatus, printer or similar image forming apparatus and more particularly to a developing device included in an image forming apparatus and capable of obviating erroneous toner content sensing when toner is not replenished.

2. Description of the Background Art

It is a common practice with an image forming apparatus to use a developer for developing a latent image formed on an image carrier, e.g., a photoconductive element. The developer is, in many cases, implemented as a toner and carrier mixture or two-ingredient type developer. Toner and carrier constituting this type of developer are agitated and mixed together in a developing device. As a result, the toner is charged to preselected polarity by friction. When the toner is consumed due to repeated development, fresh toner is replenished to the developing device to thereby maintain the toner content of the developer constant.

The toner content of the developer may be determined in terms of the permeability of the developer that varies in accordance with the bulk density of the carrier. The toner content of the developer is sensed not only when fresh toner is replenished, but also when it is not replenished with the developer being agitated. When fresh toner is not replenished, the toner content of the developer in the developing device is not expected to vary. In practice, however, when the amount of charge deposited on carrier grains by friction increases, the carrier grains repulse each other and reduce the bulk density of the developer. Consequently, the toner content is sensed in the same manner as when fresh toner is replenished, resulting in erroneous sensing of toner replenishment.

A sensor is used to sense the toner content of the developer being agitated. To protect the sensor from erroneous sensing, Japanese Patent Laid-Open Publication No. 5-150650, for example, discloses an arrangement including a cleaning blade mounted on a member that conveys a developer. The cleaning blade wipes the sensing surface of the sensor. In addition, fluorine is coated on the cleaning blade and the inside of a case around the sensing surface. This arrangement prevents the toner from depositing on the sensing surface.

Japanese Patent Laid-Open Publication No. 5-323794, for example, teaches a sensor protruding into the space of a developing device storing a developer through the wall of the developing device. An agitating member has a blade whose diameter is small so as not to interfere with the sensor protruding into the above space.

The prior art arrangements described above address the deposition of the developer on the sensing surface of the sensor, but do not address erroneous toner content sensing to occur when fresh toner is not replenished. More specifically, the prior art arrangements each agitate the developer when toner is not replenished, so that the bulk density of the developer is expected to vary. However, neither one of the above arrangements includes a measure against a decrease in the bulk density of the developer due to agitation to occur when toner is not replenished.

Technologies relating to the present invention are also disclosed in, e.g., Japanese Patent Laid-Open Publication Nos. 6-19315 and 2000-56555.

SUMMARY OF THE INVENTION

It is an object of the present invention to provide a developing device capable of obviating erroneous toner content sensing when fresh toner is not replenished, and an image forming apparatus including the same.

A developing device of the present invention includes a conveying member for conveying a developer consisting of toner grains and carrier grains. A sensor senses the toner content of the developer in terms of the permeability of the developer. A preventing member prevents the bulk density of the developer from varying when fresh toner is not replenished.

An image forming apparatus including the developing device is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1A:
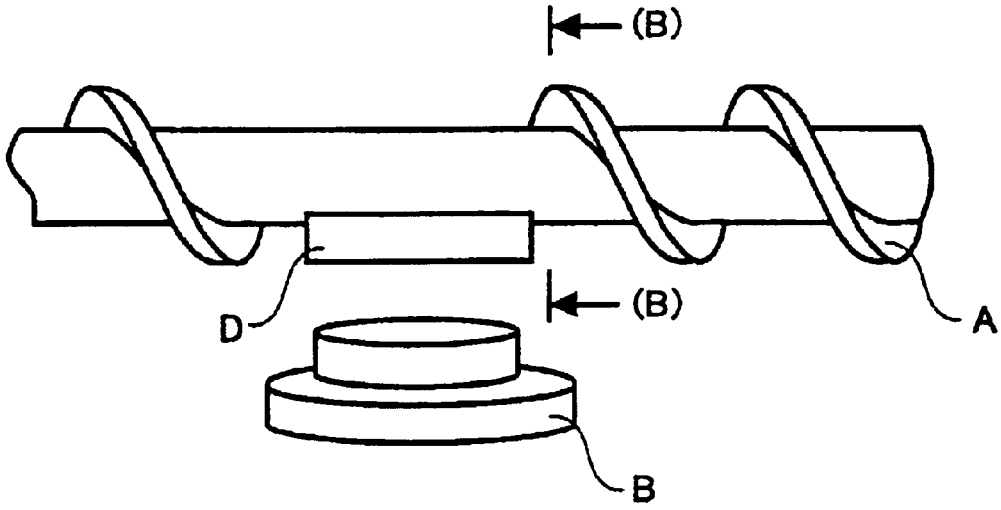
FIG.1A PRIOR ART
FIG. 1A is a front view showing an agitating section included in a prior art developer conveying device.
Figure 1B:
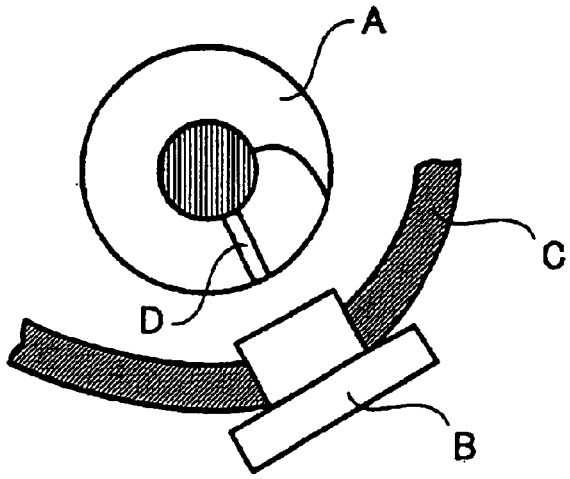
FIG.1B PRIOR ART
FIG. 1B is a section along line (B)—(B) shown in FIG. 1A.
Figure 2:
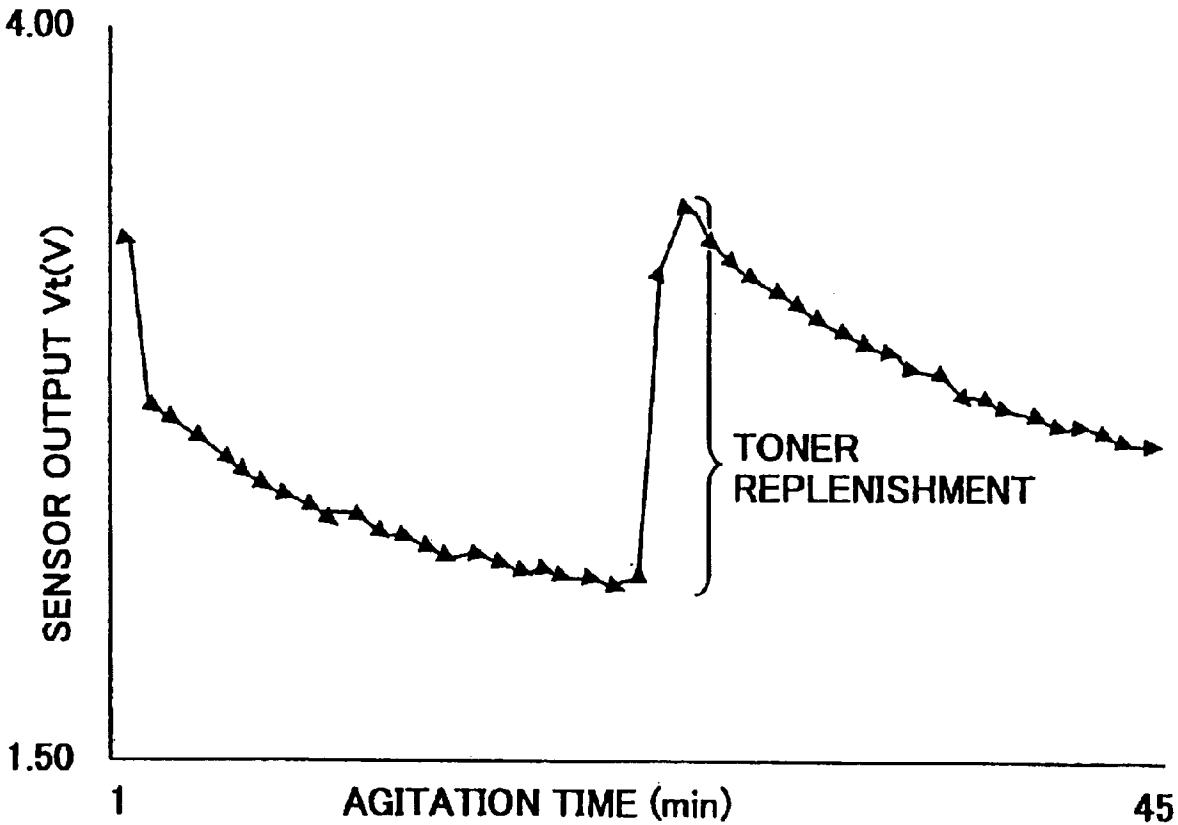
FIG. 2 PRIOR ART
FIG. 2 is a graph showing a relation between the duration of agitation and the toner content of a developer sensed.

To better understand the present invention, how the toner content of a developer varies due to agitation when fresh toner is not replenished will be described with reference to FIGS. 1A, 1B and 2. As shown in FIGS. 1A and 1B, a screw or developer conveying member A has a blade D positioned to face a sensor or sensing means B in the axial direction of the screw A. Assume that the screw A continuously agitates a developer with the blade D when fresh toner is not replenished. Then, as shown in FIG. 2, the output of the sensor B representative of the toner content of the developer drops despite that it is not expected to do so. When the sensor output noticeably varies in the above condition, it is determined that fresh toner is replenished despite that it is not replenished. This prevents the toner content of the developer from being accurately sensed.

Figure 3:
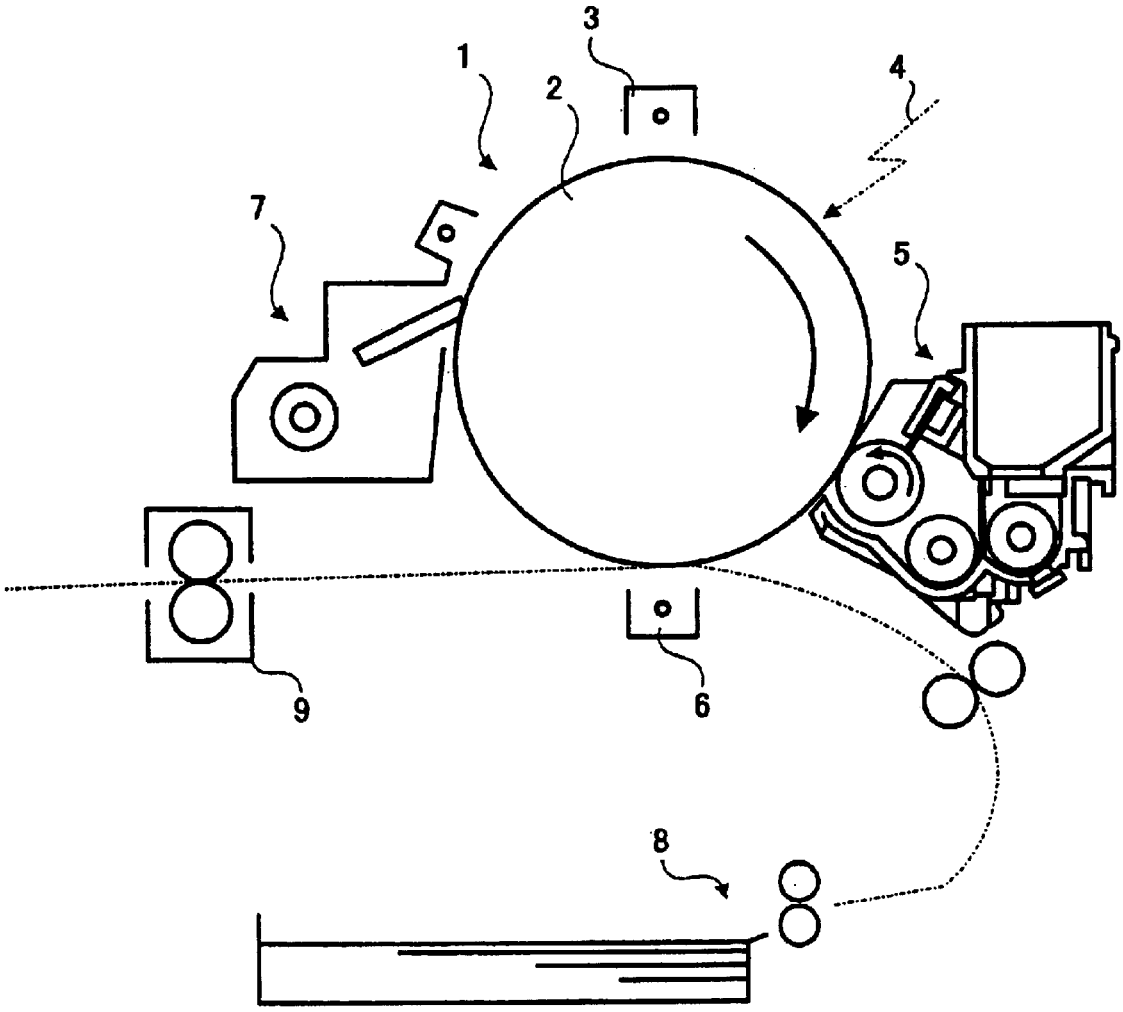
FIG. 3 is a view showing an image forming apparatus including a developing device embodying the present invention.

Referring to FIG. 3, a developing device embodying the present invention and an image forming apparatus including the same are shown. The image forming apparatus is implemented as a printer by way of example. As shown, the printer, generally 1, includes a photoconductive drum or image carrier 2 rotatable in a direction indicated by an arrow. A charger 3, a writing unit 4, a developing device 5, an image transferring unit 6 and a cleaning unit 9 are sequentially arranged around the drum 2 in the direction of rotation of the drum 2.

While the drum 2 is in rotation, the charger 3 uniformly charges the surface of the drum 2. The writing unit 4 optically scans the charged surface of the drum 2 in accordance with image data to thereby form a latent image. The developing device 5 develops the latent image with toner for thereby producing a corresponding toner image. The image transferring unit 6 transfers the toner image from the drum 2 to a sheet fed from a sheet cassette 8. The fixing unit 9 fixes the toner image on the sheet. After the image transfer, a drum cleaner 7 removes the toner and charge left on the drum 2. The charger 3 again uniformly charges the cleaned surface of the drum 2 for thereby preparing it for the next image forming cycle.

Figure 4:
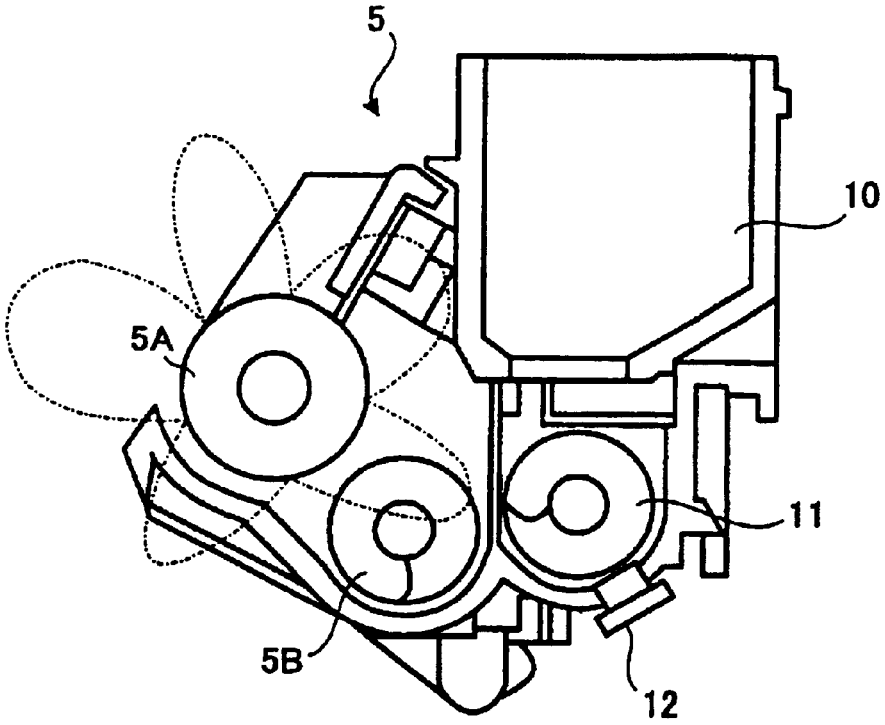
FIG. 4 is a fragmentary view of essential part of the illustrative embodiment.

In the illustrative embodiment, the developing device 5 forms a magnet brush with a developer made up of toner and carrier. Specifically, as shown in FIG. 4, the developing device 5 includes a rotatable sleeve 5A facing the drum 2. A feed screw 5B adjoins the sleeve 5A for feeding the developer to the sleeve 5A. A toner cartridge 10 storing fresh toner therein is removably mounted to the casing of the developing device 5. A conveyance screw or conveying means 11 conveys the toner discharged from the toner cartridge 10. The feed screw 5B and conveyance screw 11 are parallel to each other and have leads opposite in direction to each other. The two screws 5B and 11 therefore circulate the developer within the developing device 5 in the axial direction to thereby replenish the fresh toner while agitating it.

A sensor or sensing means 12 is mounted on the casing of the developing device 5 at a position adjoining the conveyance screw 11. The sensor 12 senses the toner content of the developer mixed and agitated during conveyance. In the illustrative embodiment, the sensor 12 senses the toner content in terms of the permeability of the developer.

Figure 5:
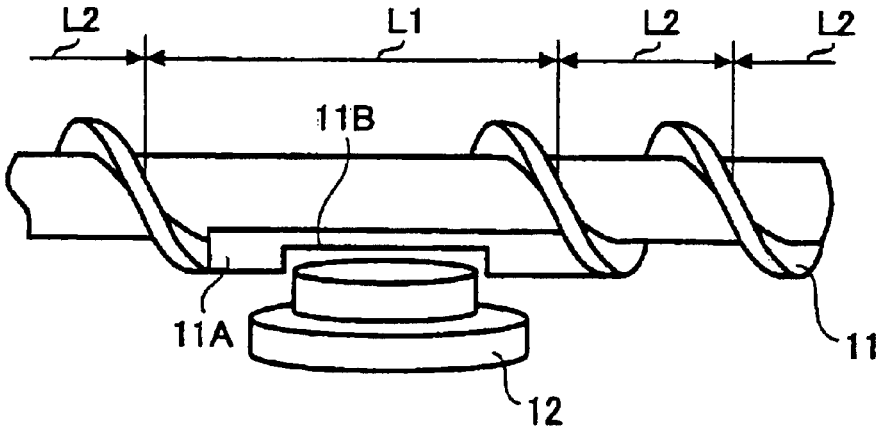
FIG. 5 is a front view showing a specific configuration of conveying means included in the developing device of the illustrative embodiment.

FIG. 5 shows a specific configuration of the conveyance screw 11. As shown, the screw 11 has, in the axial direction, a greater lead at a portion L1 facing the sensor 12 than at the other portions L2. A continuous agitating member 11A extends on the screw 11 over the above portion L1 in the axial direction of the screw 11. The agitating member 11A is extended toward the sensor 12 except for the range occupied by the sensor 12. More specifically, the agitating member 11A is sized smaller in the above particular range than in the other ranges. In the illustrative embodiment, the agitating member 11A is formed with a notch 11B over the range occupied by the sensor 12. The sensor 12 is received in the notch 11B, so that the agitating member 11A surrounds the sensor 12 inclusive of the sensing surface of the sensor 12.

When the conveyance screw 11 rotates about its axis, the agitating member 11A on the screw 11 forcibly agitates the developer around the sensor 12 and thereby makes it sparse beforehand. It follows that the bulk density of the developer does not noticeably decrease even when it is continuously agitated. This obviates an occurrence that the bulk density varies when fresh toner is not replenished as noticeably as when it is replenished.

Figure 6:
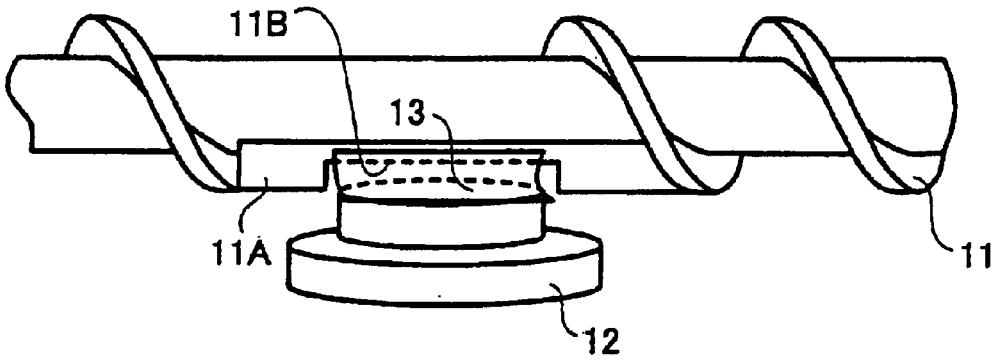
FIG. 6 is a front view showing another specific configuration of the conveying means.

FIG. 6 shows another specific configuration of the conveyance screw 11. As shown, a thin polyurethane sheet or elastic member 13 is fitted on the wall of the notch 11*b* facing the sensing surface of the sensor 12. The thin sheet 13 rubs against the sensing surface of the sensor 12 to thereby forcibly agitate the developer on and above the sensing surface. The thin sheet 13 elastically deforms when rubbing against the sensing surface, and therefore does not scratch the sensing surface at all.

In the configuration shown in FIG. 6, the sheet 13 forcibly agitates the developer on and above the sensing surface of the sensor 12 without regard to the accuracy of positioning and machining of the sensor 12 and agitating member 11. The developer forcibly agitated at the above position becomes sparse beforehand. This is also successful to prevent the bulk density from noticeably varying when toner is not replenished.

Figure 7:
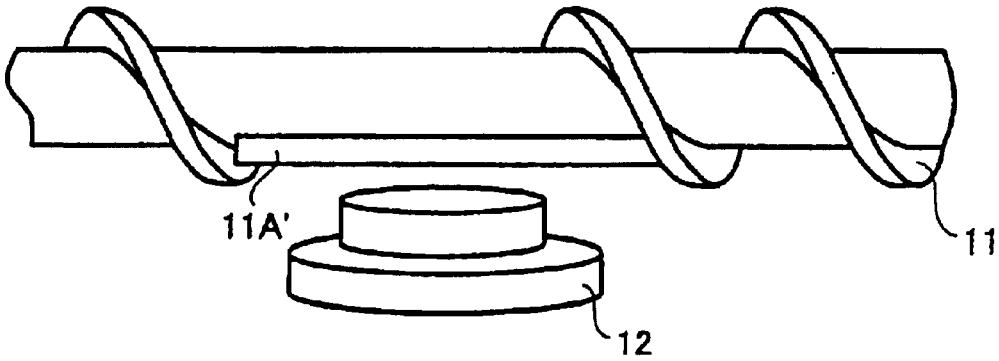
FIG. 7 is a front view showing a conventional agitating member.
Figure 8:
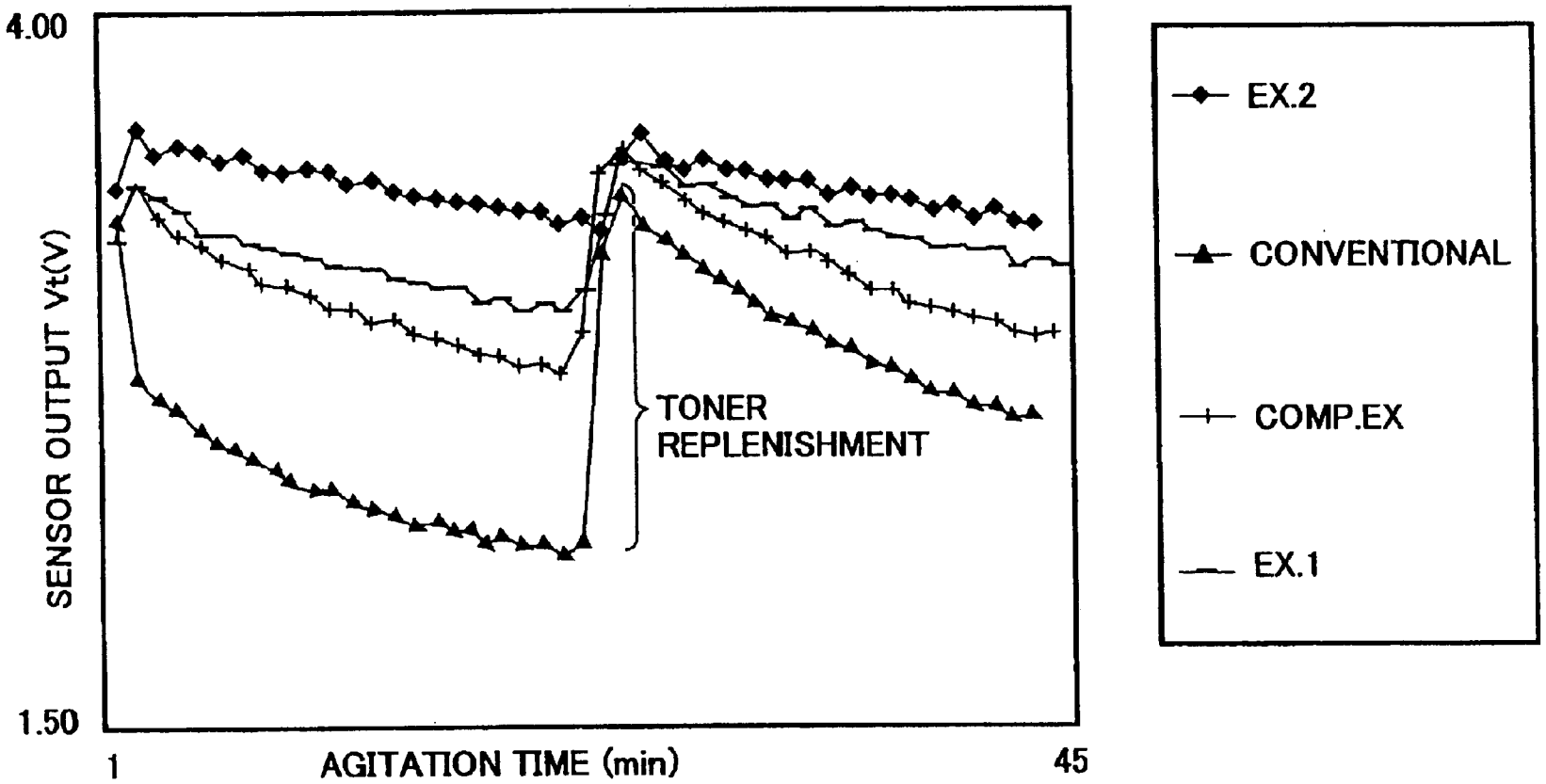
FIG. 8 is a graph comparing the specific configurations of FIGS. 5 and 6 and a comparative example as to the variation of a sensor output.

FIG. 8 compares the specific configurations of FIGS. 5 and 6 and a comparative example. In FIG. 8, Examples 1 and 2 (Exs. 1 and 2) refer to the configurations of FIGS. 5 and 6, respectively, while Comparative Example (Comp. Ex.) refers to the arrangement taught in Laid-Open Publication No. 5-150650 discussed earlier. As shown in FIG. 7, in Comparative Example, an agitating member, labeled 11A', is positioned on the conveyance screw 11, but simply configured to face the sensor 12.

As FIG. 8 indicates, Examples 1 and 2 successfully reduce the drop of sensor output and make the sensor output stable, compared to Comparative Example and Conventional. Examples 1 and 2 therefore reduce erroneous sensing ascribable to the noticeable variation of sensor output when toner is not replenished.

In summary, it will be seen that the present invention provides a developing device and an image forming apparatus having various unprecedented advantages, as enumerated below.

(1) An agitating member agitates a developer not only above the sensing surface of sensing means but also at opposite sides of the sensing surface. The agitating member therefore forcibly makes the developer around the sensing means sparse to thereby reduce its bulk density. This reduces the variation of the output of the sensing means when toner is not replenished, thereby obviating erroneous sensing.

(2) The agitating member, which faces the sensing means, receives the sensing means in a notch thereof. The agitating member therefore efficiently, forcibly agitates even the developer positioned at the sides of the sensing means. This prevents the bulk density of the developer around the sensing means from noticeably increasing and thereby allows the sensing means to accurately sense the actual toner content of the developer.

(3) A thin polyurethane sheet or elastic member is fitted on the wall of the notch facing the sensing means. The elastic sheet wipes the sensing surface of the sensor without scratching it. The agitating member therefore evenly agitates the developer not only around the sensing means but also on the sensing surface. This is also successful to achieve the advantage (1).

(4) Even when agitation is continued without fresh toner being replenished, the bulk density of the developer does not vary. This obviates erroneous sensing and therefore promotes adequate toner content control.

Various modifications will become possible for those skilled in the art after receiving the teachings of the present disclosure without departing from the scope thereof.

What is claimed is:

1. A developing device comprising:

conveying means for conveying a developer having a toner and carrier mixture, the conveying means including a threaded portion;

sensing means for sensing a toner content of the developer by determining a permeability of said developer; and preventing means for preventing a bulk density of the developer from varying when additional toner is not provided, the preventing means comprising a first portion configured to be disposed adjacent a top surface of the sensing means and a second portion configured to be disposed adjacent a side surface of the sensing means and extending a greater distance than the first portion.

2. The developing device according to claim 1, wherein said preventing means comprises an agitating member for agitating the developer around said sensing means.

3. A developing device comprising:

conveying means for conveying a developer having a toner and carrier mixture, the conveying means including a threaded portion;

sensing means for sensing a toner content of the developer by determining a permeability of said developer; and preventing means for preventing a bulk density of the developer from varying when additional toner is not provided, the preventing means disposed between surfaces of the threaded portion, wherein said preventing means comprises an agitating member for agitating the developer around said sensing means, and wherein said agitating member faces said sensing means and extends toward said sensing means except for a range occupied by said sensing means in a lengthwise direction of said agitating member.

4. The developing device according to claim 3, wherein the lengthwise direction of said agitating member is coincident with a widthwise direction of a sheet, and said agitating member includes a notch facing said sensing means in said lengthwise direction and receiving said sensing means.

5. The developing device according to claim 3, wherein a portion of said agitating member facing said sensing means comprises an elastic material.

6. A developing device comprising:

conveying means for conveying a developer having a toner and carrier mixture;

sensing means for sensing a toner content of the developer by determining a permeability of said developer; and preventing means for preventing a bulk density of the developer from varying when additional toner is not provided, said preventing means comprising an agitating member for agitating the developer around said sensing means, wherein said agitating member faces said sensing means and extends toward said sensing means except for a range occupied by said sensing means in a lengthwise direction of said agitating member, wherein a portion of said agitating member facing said sensing means comprises an elastic material, and wherein said portion of said agitating member comprises a thin polyurethane sheet.

7. A developing device comprising:

conveying means for conveying a developer having a toner and carrier mixture, the conveying means including a threaded portion;

sensing means for sensing a toner content of the developer by determining a permeability of said developer; and preventing means for preventing a bulk density of the developer from varying when additional toner is not provided, the preventing means disposed between surfaces of the threaded portion, wherein said preventing means comprises an agitating member facing said sensing means, and said agitating member extends toward said sensing means except for a range occupied by said sensing means in a lengthwise direction of said agitating member.

8. The developing device according to claim 7, wherein the lengthwise direction of said agitating member is coincident with a widthwise direction of a sheet, and said agitating member includes a notch facing said sensing means in said lengthwise direction and receiving said sensing means.

9. The developing device according to claim 7, wherein a portion of said agitating member facing said sensing means comprises an elastic material.

10. A developing device comprising:

conveying means for conveying a developer having a toner and carrier mixture;

sensing means for sensing a toner content of the developer by determining a permeability of said developer; and preventing means for preventing a bulk density of the developer from varying when additional toner is not provided, wherein a portion of said agitating member facing said sensing means comprises an elastic material, wherein said preventing ember comprises an agitating member facing said sensing means, and said agitating member extends toward said sensing means except for a range occupied by said sensing means in a lengthwise direction of said agitating member, and wherein said portion of said agitating member comprises a thin polyurethane sheet.

11. In an image forming apparatus including a developing device adapted to store a developer having toner grains and carrier grains, said developing device comprising:

conveying means for conveying the developer, the conveying means including a threaded portion;

sensing means for sensing a toner content of the developer by determining a permeability of said developer; and preventing means for preventing a bulk density of the developer from varying when additional toner is not provided, the preventing means comprising a first portion configured to be disposed adjacent a too surface of the sensing means and a second portion configured to be disposed adjacent a side surface of the sensing means and extending a greater distance than the first portion.

* * * * *